US009281626B2

(12) United States Patent
Lin et al.

(10) Patent No.: US 9,281,626 B2
(45) Date of Patent: Mar. 8, 2016

(54) MATING CONNECTOR

(71) Applicant: LOTES CO., LTD, Keelung (TW)

(72) Inventors: Wen Wei Lin, Keelung (TW); Chen Hui Zeng, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 14/502,829

(22) Filed: Sep. 30, 2014

(65) Prior Publication Data

US 2015/0364871 A1 Dec. 17, 2015

(30) Foreign Application Priority Data

Jun. 13, 2014 (CN) ..... 2014 2 0334705

(51) Int. Cl.
*H01R 13/648* (2006.01)
*H01R 13/6581* (2011.01)

(52) U.S. Cl.
CPC ..... *H01R 13/6581* (2013.01)

(58) Field of Classification Search
CPC .... H01R 12/77; H01R 13/64; H01R 13/6581; H01R 13/6594; H01R 12/70478
USPC ..... 439/607.4, 607.41, 607.53–607.56, 439/353, 357–358
See application file for complete search history.

(56) References Cited

U.S. PATENT DOCUMENTS 6,257,914 B1 * 7/2001 Comerci ..... H01R 13/6273 439/357
6,799,986 B2 * 10/2004 Igarashi ..... H01R 13/6275 439/358
7,758,379 B2 * 7/2010 Chen ..... H01R 13/6485 439/607.11
8,684,769 B2 * 4/2014 Kao ..... H01R 13/6471 439/607.28
8,968,031 B2 * 3/2015 Simmel ..... H01R 13/659 439/108

* cited by examiner

*Primary Examiner* — Xuong Chung Trans
(74) *Attorney, Agent, or Firm* — Locke Lord LLP; Tim Tingkang Xia, Esq.

(57) ABSTRACT

A mating connector includes a plastic body, a first terminal group and a second terminal group received in the plastic body, a retaining elastic sheet retained at the plastic body and located at a side of the first terminal group and the second terminal group, a middle shielding sheet located between the first terminal group and the second terminal group, and a shielding case contacting the middle shielding sheet. An urging portion is extended from the middle shielding sheet and abuts the retaining elastic sheet. The middle shielding sheet shields an interference signal between plate surfaces of the first and second terminal groups. The retaining elastic sheet shields an interference signal between side surfaces of the first and second terminal groups.

16 Claims, 8 Drawing Sheets

100

MATING CONNECTOR

CROSS-REFERENCE TO RELATED APPLICATION

This non-provisional application claims priority under 35 U.S.C. §119(a) on Patent Application No. 201420334705.2 filed in P.R. China on Jun. 13, 2014, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to a mating connector, and in particular, to a mating connector for mating to an electrical connector.

BACKGROUND OF THE INVENTION

An existing mating connector is used to mate with an electrical connector. The mating connector mainly includes a plastic body, a first terminal group and a second terminal group received in the plastic body, a middle shielding sheet, and a shielding case. The first terminal group and the second terminal group are disposed in an upper row and a lower row in the plastic body. The middle shielding sheet is retained at the plastic body, and located between the first terminal group and the second terminal group. The shielding case covers the plastic body, and contacts the middle shielding sheet to ground the middle shielding sheet. An interference signal is easily generated between the first terminal group and the second terminal group during a signal transmission process, and the middle shielding sheet is located between the first terminal group and the second terminal group to shield the interference signal, thereby achieving a desirable shielding effect.

However, the middle shielding sheet only forms a shielding area between a plate surface of the first terminal group and a plate surface of the second terminal group, and a shielding function cannot be implemented between a side surface of the first terminal group and a side surface of the second terminal group. Therefore, an interference signal between the two side surfaces of the first terminal group and the second terminal group cannot be eliminated, and crosstalk is easily generated between the first terminal group and the second terminal group during signal transmission. As a result, a shielding effect of the mating connector is undesirable, thereby affecting signal transmission quality of the mating connector. In addition, the mating connector is not provided with any retaining apparatus. Therefore, when being mated to the electrical connector, the mating connector and the electrical connector are not securely fixed, and after mating, the mating connector and the electrical connector are not connected stably and a loosening problem easily occurs, thereby affecting electrical connection performance of the mating connector.

Therefore, a heretofore unaddressed need exists in the art to address the aforementioned deficiencies and inadequacies.

SUMMARY OF THE INVENTION

In one aspect, the present invention is directed to a mating connector with a desirable shielding effect.

In one embodiment, a mating connector includes a plastic body, a first terminal group and a second terminal group received in the plastic body, at least one retaining elastic sheet, a middle shielding sheet, and a shielding case. The first terminal group and the second terminal group are disposed in an upper row and a lower row in the plastic body. The at least one retaining elastic sheet is retained at the plastic body, and located at a side of the first terminal group and the second terminal group. The middle shielding sheet is retained at the plastic body, and located between the first terminal group and the second terminal group. At least one urging portion extends from the middle shielding sheet, and abuts the retaining elastic sheet. The shielding case covers the plastic body. The shielding case and the retaining elastic sheet are formed independently. The shielding case contacts the middle shielding sheet.

In one embodiment, one side of the plastic body is concavely provided with a receiving space. The middle shielding sheet is convexly provided with at least one protruding portion located in the receiving space. At least one pressing portion is extended from the shielding case to enter the receiving space and contacts the protruding portion.

In one embodiment, the middle shielding sheet has a body portion located in the plastic body. One end of the body portion extends to form the protruding portion, the other end of the body portion bends and extends towards the protruding portion to form the urging portion. An extending direction of the urging portion is perpendicular to an extending direction of the protruding portion.

In one embodiment, a bolstering portion is extended from the end of the body portion with the urging portion. An extending direction of the bolstering portion is opposite to that of the urging portion. The bolstering portion contacts the retaining elastic sheet.

In one embodiment, a trench is opened in the retaining elastic sheet. Two sides of the trench are respectively provided with a fixing portion. The fixing portions are fixed with the plastic body. The protruding portion passes through the trench, protrudes from the trench, and is located in the receiving space.

In one embodiment, the protruding portion contacts a side wall surface of the trench.

In one embodiment, a plate portion is extended from the fixing portion of the retaining elastic sheet. The plate portion abuts the urging portion. An elastic portion is extended forwards from the plate portion. The elastic portion is located at a front end of the plastic body and is used to press an electrical connector.

In one embodiment, the retaining elastic sheet is perpendicular to the middle shielding sheet.

In one embodiment, a side wall of the plastic body is concavely provided with a hollowed portion. One end of the retaining elastic sheet is retained at the plastic body, the other end of the retaining elastic sheet is a free end, and the free end of the retaining elastic sheet is located in the hollowed portion.

In one embodiment, the plastic body includes a frame body, an upper module, and a lower module. The upper module and the first terminal group are integrated through insertion molding. The lower module and the second terminal group are integrated through insertion molding. The middle shielding sheet is sandwiched between the upper module and the lower module. The upper module and the lower module are fixed in the frame body. A front end of the frame body is provided with multiple terminal slots. Both the first terminal group having multiple first connection guiding portions and the second terminal group having multiple second connection guiding portions are located in the terminal slots.

In one embodiment, the upper module is convexly provided with a fastening block. The lower module is concavely provided with a fastening groove. The middle shielding sheet is provided with a mounting hole corresponding to the fastening block. The fastening block penetrates the mounting hole to be fastened to the fastening groove.

In one embodiment, the mating connector further includes an upper shielding sheet and a lower shielding sheet separately retained at the frame body. The upper shielding sheet is located above the first terminal group, and the lower shielding sheet is located below the second terminal group. Both the upper shielding sheet and the lower shielding sheet are provided with at least one grounding portion to contact the shielding case. Both the upper shielding sheet and the lower shielding sheet are provided with at least one mating portion to contact the electrical connector.

In one embodiment, both the upper shielding sheet and the lower shielding sheet are provided with a through-hole area. The multiple first connection guiding portions and the multiple second connection guiding portions are located in the through-hole area.

In one embodiment, the mating connector is used to mate with the electrical connector. The electrical connector includes a metal case, and both the upper shielding sheet and the lower shielding sheet abut the metal case.

In one embodiment, the mating connector is used to mate with the electrical connector. The electrical connector includes an upper grounding sheet, a lower grounding sheet, and a metal case. The upper grounding sheet contacts the metal case, the lower grounding sheet contacts the upper grounding sheet. At least one contact arm is extended from the lower grounding sheet, and the contact arm contacts the retaining elastic sheet.

In one embodiment, both the upper grounding sheet and the lower grounding sheet are provided with at least one concave portion. The concave portion of the upper grounding sheet contacts the mating portion of the upper shielding sheet, and the concave portion of the lower grounding sheet contacts the mating portion of the lower shielding sheet.

Compared with the related art, the present invention has the following beneficial advantages.

The middle shielding sheet is located between the first terminal group and the second terminal group and contacts the shielding case, and therefore shields an interference signal between a plate surface of the first terminal group and a plate surface of the second terminal group; and the retaining elastic sheet is located at a side of the first terminal group and the second terminal group and abuts the urging portion of the middle shielding sheet, and therefore shields an interference signal between a side surface of the first terminal group and a side surface of the second terminal group and eliminates the interference signal between the two side surfaces of the first terminal group and the second terminal group, thereby enhancing an anti-interference capability of the mating connector, ensuring a desirable shielding effect of the mating connector, and improving signal transmission quality. In addition, the retaining elastic sheet is retained at the plastic body to provide stable plugging and unplugging forces for the mating connector, so as to ensure that the mating connector and the electrical connector are mated securely and connected stably, and a loosening problem does not occur easily, thereby ensuring electrical connection performance of the mating connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
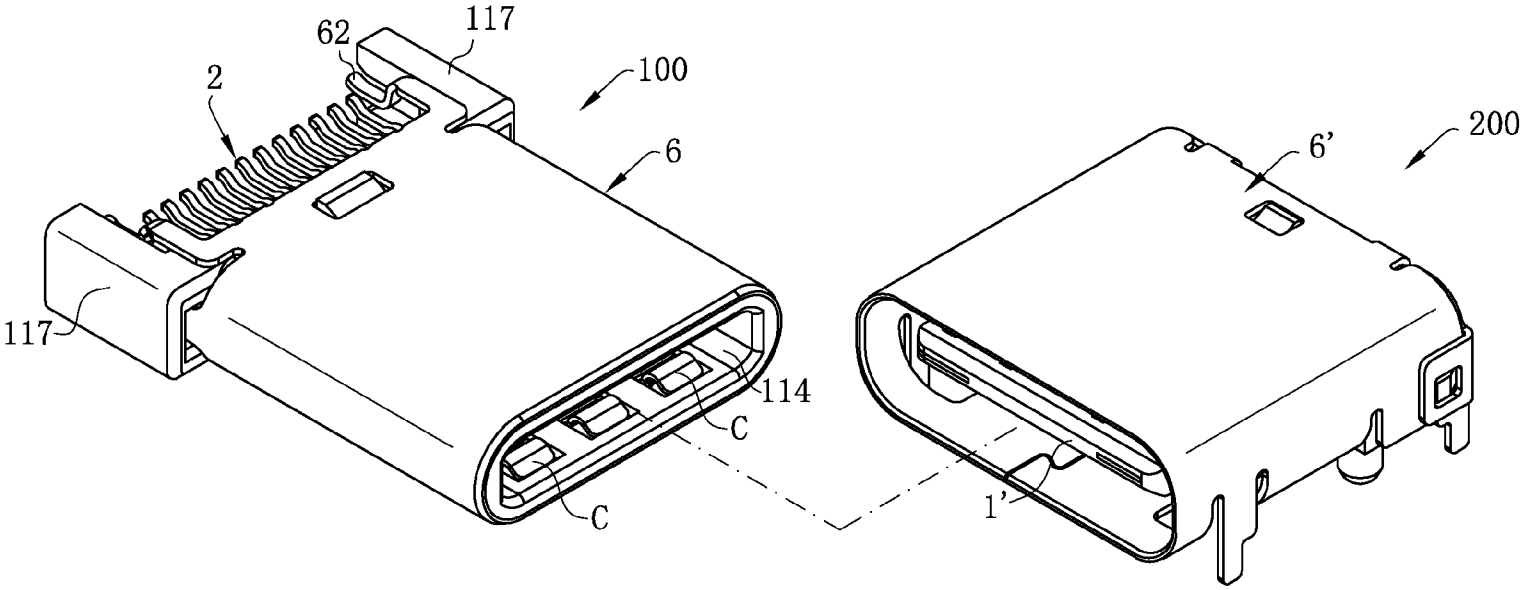
FIG. 1 is a schematic three-dimensional assembly view of a mating connector and an electrical connector before mating according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-8. In accordance with the purposes of this invention, as embodied and broadly described herein, this invention, in one aspect, relates to a mating connector.

Figure 2:
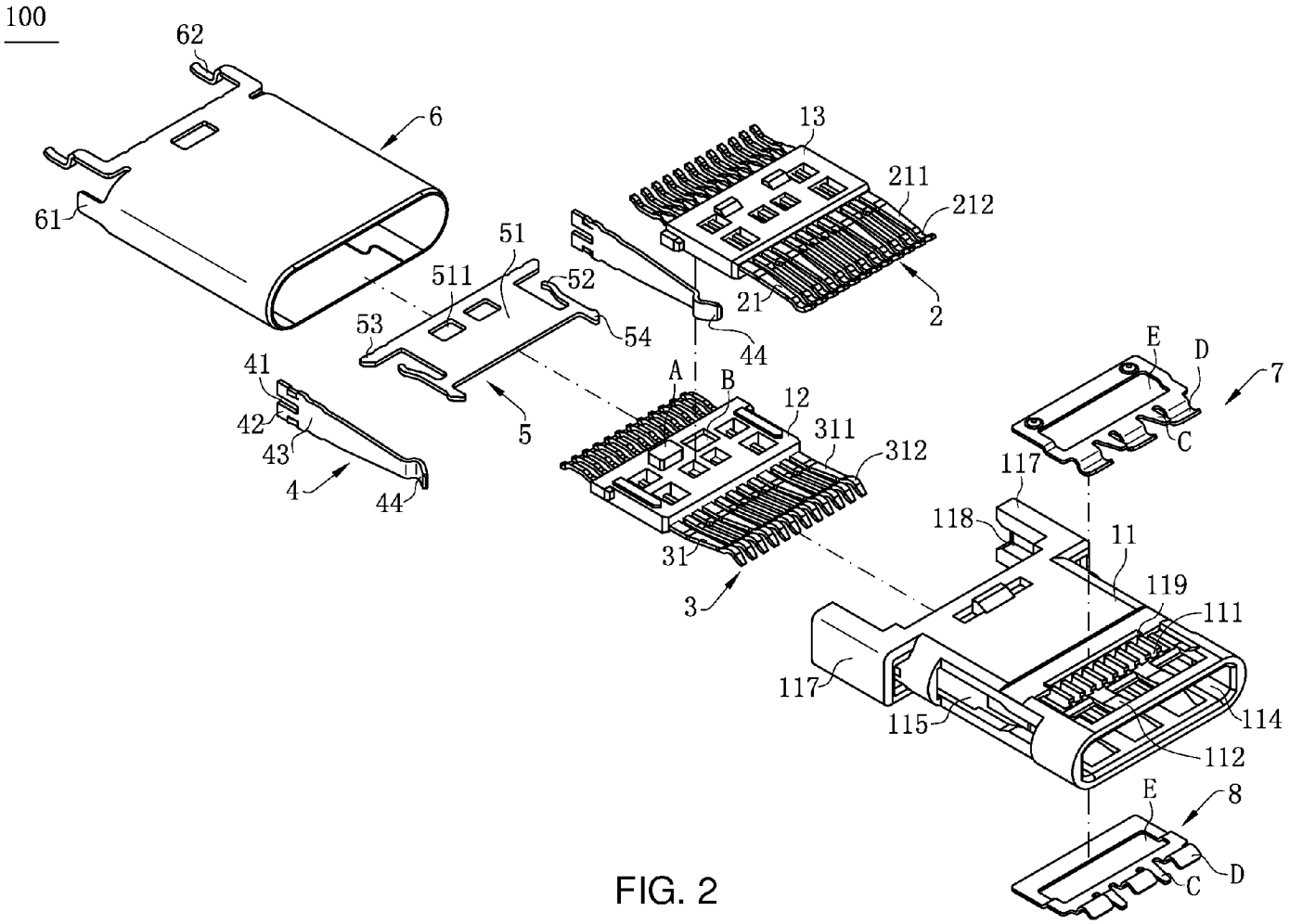
FIG. 2 is a schematic three-dimensional exploded view of a mating connector according to one embodiment of the present invention.

As shown in FIG. 1 and FIG. 2, a mating connector 100 according to one embodiment of the present invention is used to mate with an electrical connector 200. The mating connector 100 includes a plastic body 1, a first terminal group 2 and a second terminal group 3 received in the plastic body 1, at least one retaining elastic sheet 4 retained at the plastic body 1, a middle shielding sheet 5 retained at the plastic body 1, and a shielding case 6. The first terminal group 2 and the second terminal group 3 are disposed in an upper row and a lower row in the plastic body 1. In this embodiment, there are two retaining elastic sheets 4. In other embodiments, there may be one or more retaining elastic sheets 4. The middle shielding sheet 5 is located between the first terminal group 2 and the second terminal group 3. At least one urging portion 52 is extended from the middle shielding sheet 5. The urging portion 52 abuts the retaining elastic sheet 4. In this embodiment, two urging portions 52 are extended from the middle shielding sheet 5 and correspondingly abut the retaining elastic sheets 4. In other embodiments, there may be one or more urging portions 52 as long as each urging portion 52 abuts each retaining elastic sheet 4. The shielding case 6 covers the plastic body 1, and contacts the middle shielding sheet 5.

Figure 5:
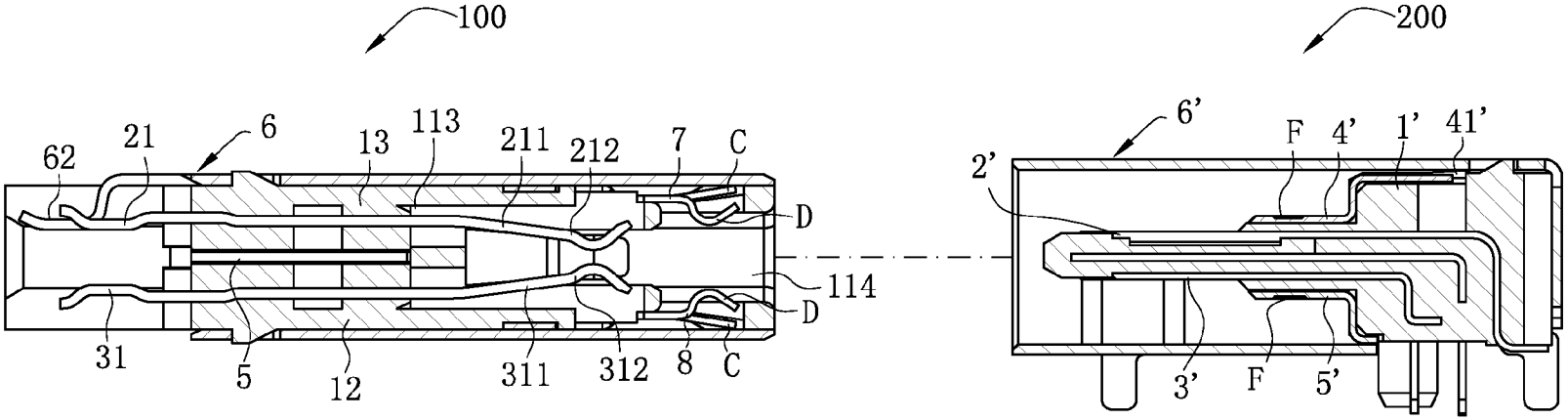
FIG. 5 is a schematic plane sectional view of a mating connector and an electrical connector before mating according to one embodiment of the present invention.
Figure 7:
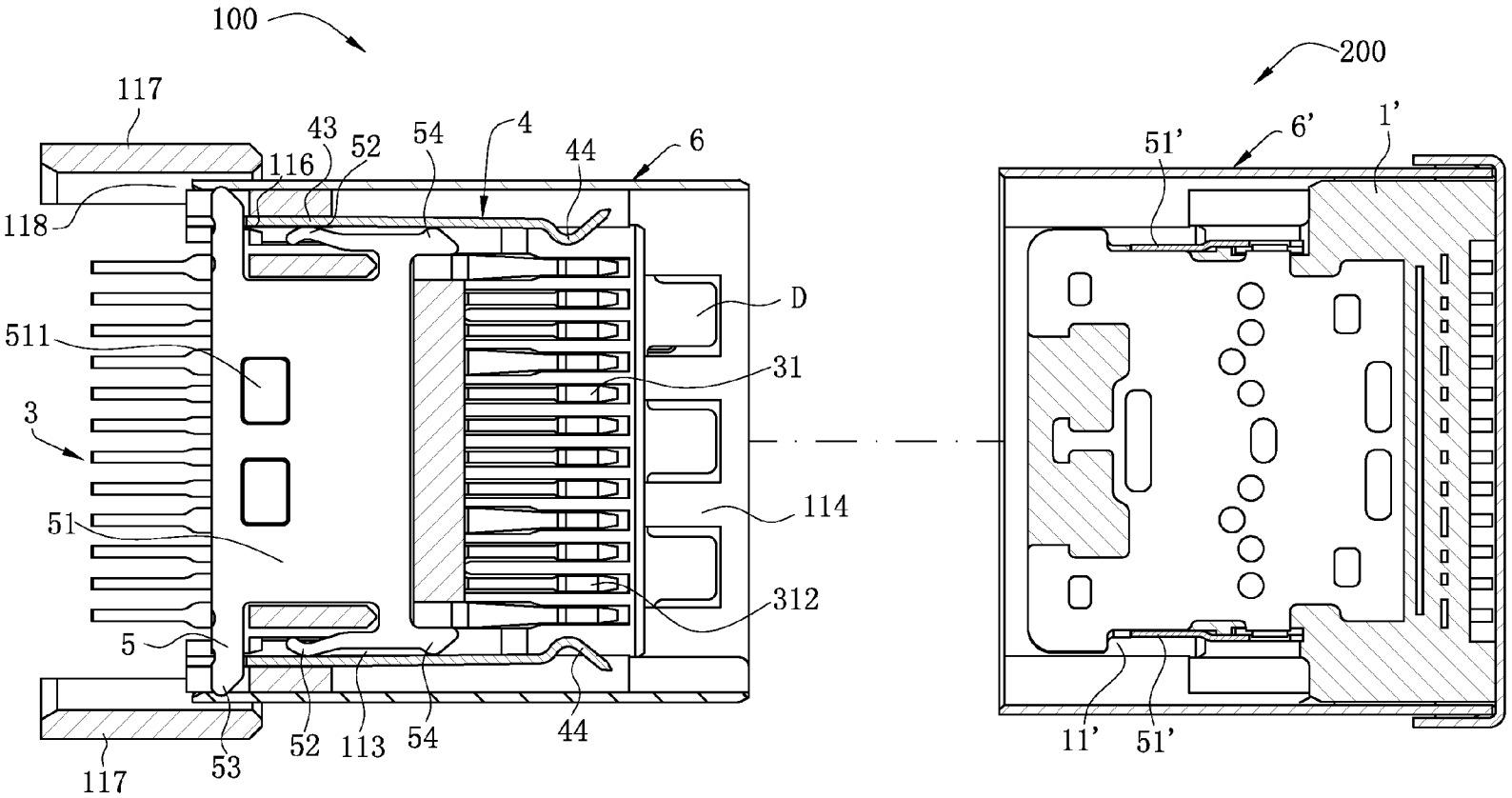
FIG. 7 is a schematic top view of a mating connector and an electrical connector before mating according to one embodiment of the present invention.

As shown in FIGS. 2, 5, and 7, the plastic body 1 includes a frame body 11, an upper module 12, and a lower module 13. Multiple terminal slots are opened at a front end of the frame body 11, and are respectively multiple upper-row terminal slots 111 and multiple lower-row terminal slots (not labeled). The upper-row terminal slots 111 and the lower-row terminal slots partially penetrate a top surface and a bottom surface of the frame body 11. The first terminal group 2 is located in the upper-row terminal slots 111, and the second terminal group 3 is located in the lower-row terminal slots. Multiple support portions 112 are convexly provided in front of the terminal slots on the frame body 11. The support portions 112 are disposed in a tilted manner. A positioning space 113 is opened forwards from a rear end surface of the frame body 11. The upper module 12 and the lower module 13 are located in the positioning space 113, and the terminal slots are connected to the positioning space 113. A mating space 114 is provided at the front end of the frame body 11 to receive the electrical connector 200. The mating space 114 is connected to the upper-row terminal slots 111 and the lower-row terminal slots. The front ends of two opposite side walls of the frame body 11 are respectively provided with a hollowed portion 115 in a concave manner. The rear ends of the two opposite side walls of the frame body 11 are respectively provided with a retaining groove 116 in a concave manner in a vertical direction. One end of the retaining elastic sheet 4 is located in the retaining groove 116, and the other end of the retaining elastic sheet 4 is located in the hollowed portion 115. Two sides of the rear end of the frame body 11 each extend backwards to form a stop wall 117. A receiving space 118 is provided in a concave manner between two opposite stop walls 117, and connected to the positioning space 113. A circuit board (not shown) is fixed in the receiving space 118, and the first terminal group 2 and the second terminal group 3 are soldered on the circuit board. The upper module 12 is located above the lower module 13. The upper module 12 and the first terminal group 2 are integrally formed through insertion molding, and the lower module 13 and the second terminal group 3 are integrally formed through insertion molding. The middle shielding sheet 5 is sandwiched between the upper module 12 and the lower module 13, and the urging portion 52 protrudes from external sides of the upper module 12 and the lower module 13. The upper module 12 includes a convex fastening block A and a concave fastening groove B, corresponding respectively to a concave fastening groove B and a convex fastening block A formed on the lower module 13. Each fastening block A is fastened to the corresponding fastening groove B to assemble the upper module 12 and the lower module 13 in a fixed manner. In this embodiment, the upper module 12 and the lower module 13 are each provided with a fastening block A and a fastening groove B. In another embodiment, only the upper module 12 is provided with the convex fastening block A, and the lower module 13 is provided with the concave fastening groove B. In other embodiments, only the upper module 12 is provided with the concave fastening groove B, and the lower module 13 is provided with the convex fastening block A. As a result, either or both of the upper module 12 and the lower module 13 may be randomly provided with the fastening block A and the fastening groove B as long as the upper module 12 and the lower module 13 can be securely fixed. In certain embodiments, the fastening block A and the fastening groove B may also be replaced by other retaining structures, such as fitting between a positioning hole and a positioning post as long as the upper module 12 and the lower module 13 can be securely fixed.

Figure 3:
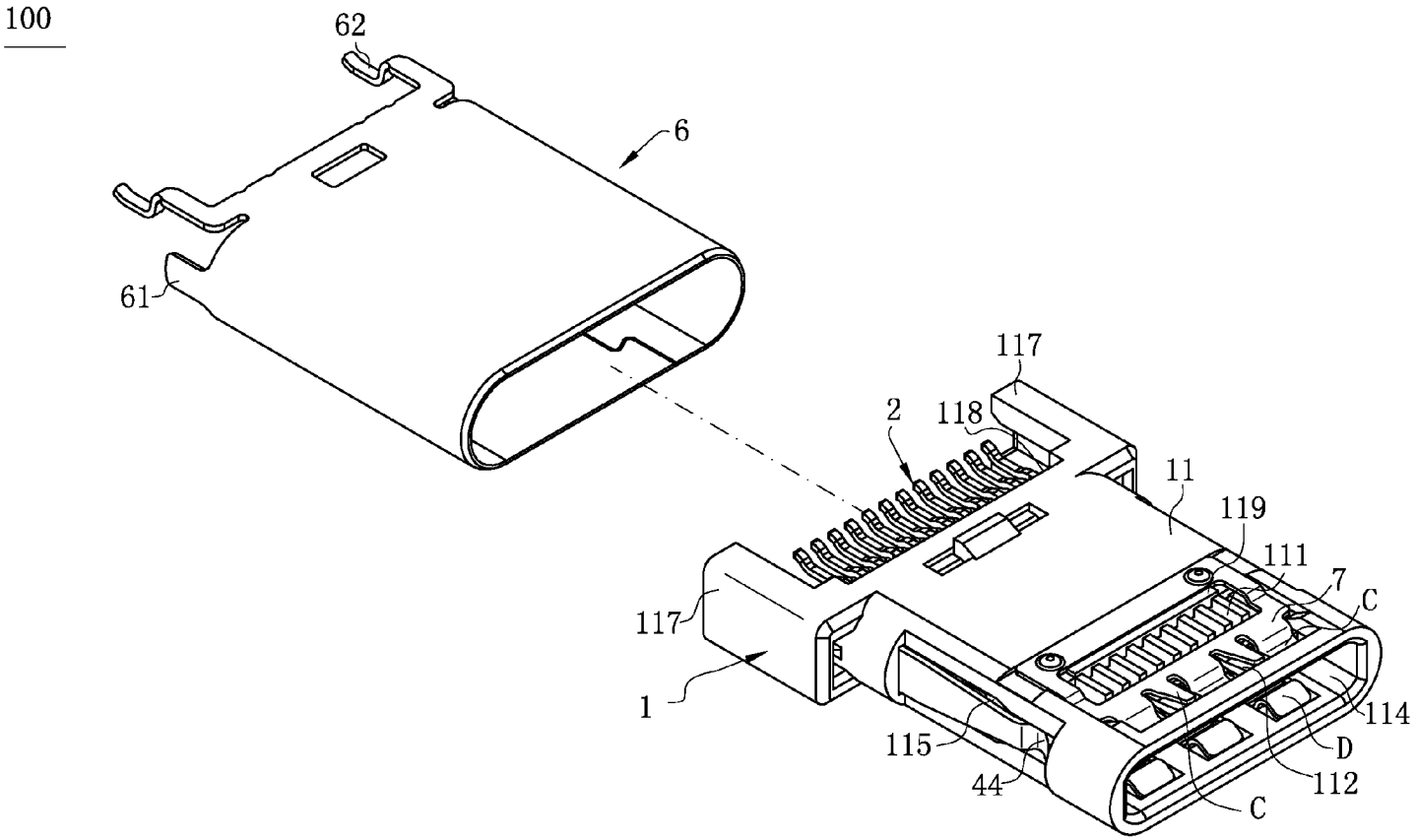
FIG. 3 is a schematic three-dimensional partial assembled view of a mating connector according to one embodiment of the present invention.

As shown in FIG. 2 and FIG. 3, the first terminal group 2 has multiple first terminals 21. Each first terminal 21 is retained at the upper module 12. A first elastic arm 211 is extended to protrude from the upper module 12 and enter the upper-row terminal slots 111. One end of the first elastic arm 211 is provided with a first connection guiding portion 212 exposed from a top surface of the frame body 11. The second terminal group 3 has multiple second terminals 31. Each second terminal 31 is retained at the lower module 13. A second elastic arm 311 is extended to protrude from the lower module 13 and enter the lower-row terminal slots. One end of the second elastic arm 311 is provided with a second connection guiding portion 312 exposed from a bottom surface of the frame body 11. Both the first connection guiding portion 212 and the second connection guiding portion 312 are located in the mating space 114, and the first terminal group 2 and the second terminal group 3 are separately soldered on the circuit board.

Figure 8:
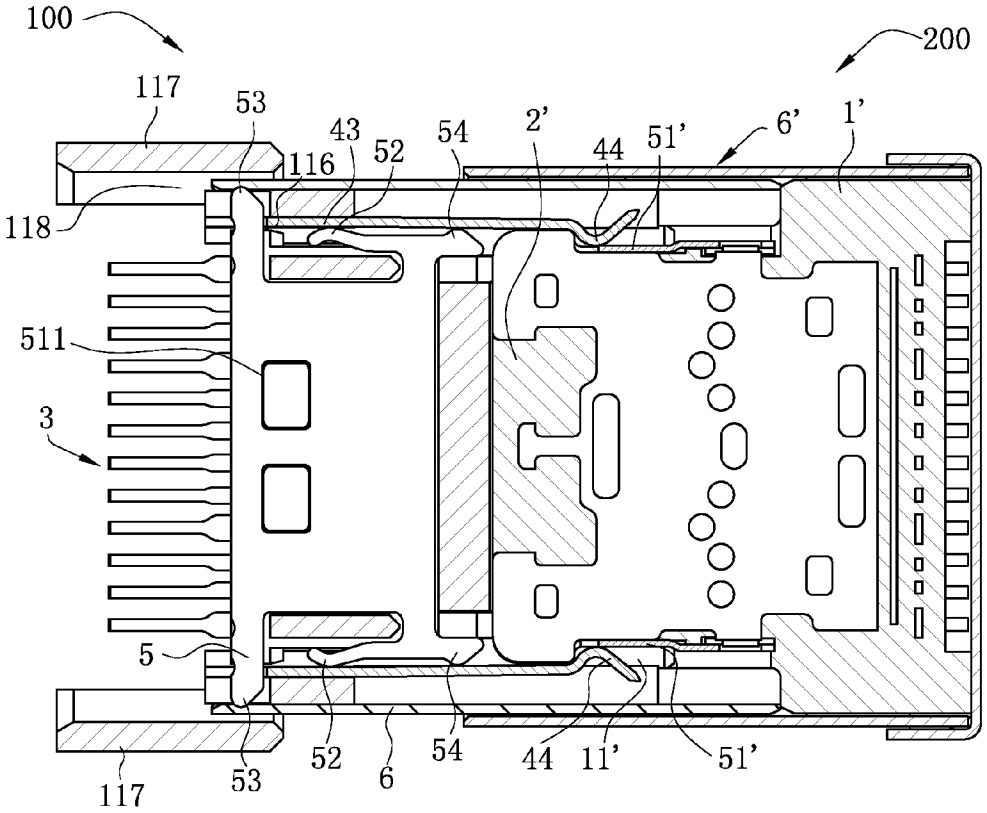
FIG. 8 is a schematic top view of a mating connector and an electrical connector after mating according to one embodiment of the present invention.

As shown in FIGS. 2, 7, and 8, the retaining elastic sheet 4 is located at a side of the first terminal group 2 and the second terminal group 3. That is, the two retaining elastic sheets 4 are respectively located at two opposite sides of the first terminal group 2 and the second terminal group 3, and the retaining elastic sheets 4 are located at two opposite sides of the middle shielding sheet 5 and are perpendicular to the shielding case 6. Each retaining elastic sheet 4 abuts the middle shielding sheet 5 to ground the retaining elastic sheet 4 and shield an interference signal between a side surface of the first terminal group 2 and a side surface of the second terminal group 3. Because the middle shielding sheet 5 is located between the first terminal group 2 and the second terminal group 3 and contacts the shielding case 6, an interference signal between a plate surface of the first terminal group 2 and a plate surface of the second terminal group 3 can be shielded. That is, the retaining elastic sheet 4 eliminates the interference signal between the two side surfaces of the first terminal group 2 and the second terminal group 3, and the middle shielding sheet 5 eliminates an interference signal between the plate surface of the first terminal group 2 and the plate surface of the second terminal group 3. Therefore, the provision of the retaining elastic sheet 4 and the middle shielding sheet 5 enhances an anti-interference capability of the mating connector 100, ensures a desirable shielding effect of the mating connector 100, and improves signal transmission quality. The retaining elastic sheet 4 is retained at the plastic body 1. A trench 41 is opened at one end of the retaining elastic sheet 4. Two sides of the trench 41 are respectively provided with a fixing portion 42. The fixing portion 42 is located in the retaining groove 116 of the frame body 11 to fix the retaining elastic sheet 4. A plate portion 43 is extended from the fixing portion 42. The plate portion 43 is located inside the frame body 11, and the plate portion 43 abuts the urging portion 52 of the middle shielding sheet 5. An elastic portion 44 is extended forwards from the plate portion 43 to protrude from the frame body 11 and enter the hollowed portion 115. The elastic portion 44 is a free end of the retaining elastic sheet 4, and is located in the hollowed portion 115 in a movable manner. The elastic portion 44 is located at a front end of the plastic body 1 and press the electrical connector 200 to provide stable plugging and unplugging forces for the mating connector 100, so that the mating connector 100 and the electrical connector 200 are mated securely and connected stably, and a loosening problem does not occur easily, thereby ensuring electrical connection performance of the mating connector 100. The elastic portion 44 is located in the hollowed portion 115 in a movable manner and presses the electrical connector 200, and the hollowed portion 115 provides a retreating space for the elastic portion 44. When the electrical connector 200 abuts the elastic portion 44, the elastic portion 44 is pressed to move out from the hollowed portion 115, so that the electrical connector 200 is conveniently inserted in the mating connector 100. When the electrical connector 200 is separated from the elastic portion 44, the elastic portion 44 is restored to an original position through the elasticity of the elastic portion 44, so that the electrical connector 200 is conveniently removed from the mating connector 100.

As shown in FIGS. 2, 7, and 8, the middle shielding sheet 5 is retained at the plastic body 1, and is located between the first terminal group 2 and the second terminal group 3 to shield an interference signal between the plate surface of the first terminal group 2 and the plate surface of the second terminal group 3. The middle shielding sheet 5 has a body portion 51 located between the upper module 12 and the lower module 13. A protruding portion 53 is extended from one end of the body portion 51 to contact the shielding case 6, and the other end of the body portion 51 bends and extends towards the protruding portion 53 to form the urging portion 52 to contact the retaining elastic sheet 4. Because the urging portion 52 extends towards the protruding portion 53, so the overall length of the middle shielding sheet 5 is reduced, the size of the mating connector 100 is reduced, and the space is saved. In this embodiment, there are two protruding portions 53, the two protruding portions 53 are separately formed transversely in a convex manner from two sides of the body portion 51, each protruding portion 53 passes through the trench 41, protrudes from the trench 41, and enters the receiving space 118 to contact the shielding case 6, and each protruding portion 53 contacts a side wall surface of the trench 41 when passing through the trench 41 (not shown). In other embodiments, there may be one protruding portion 53 as long as the protruding portion 53 is formed transversely in a convex manner from any side of the body portion 51 and contacts the shielding case 6. In this embodiment, there are two urging portions 52, the two urging portions 52 are formed by being provided transversely in a convex manner from two sides of the body portion 51 and then bending and extending vertically. An extending direction of the urging portion 52 is perpendicular to an extending direction of the protruding portion 53, and the urging portion 52 extends towards the protruding portion 53, so that the urging portion 52 conveniently contacts the plate portion 43. The urging portion 52 is elastic, and the urging portion 52 elastically abuts the plate portion 43 of the retaining elastic sheet 4. In another embodiment, there may be one urging portion 52, the urging portion 52 is formed by bending and extending from any side of the body portion 51, and the urging portion 52 and the protruding portion 53 may be located at the same side of the body portion 51 and may also be located at different sides of the body portion 51 as long as the urging portion 52 contacts the retaining elastic sheet 4. A bolstering portion 54 is extended from the end of the body portion 51 with the urging portion 52. An extending direction of the bolstering portion 54 is opposite to that of the urging portion 52, and the bolstering portion 54 contacts the retaining elastic sheet 4. The middle shielding sheet 5 contacts the retaining elastic sheet 4 by multiple points, and the contact is stable, thereby ensuring a desirable grounding effect of the retaining elastic sheet 4. Two mounting holes 511, corresponding to the fastening block A of the upper module 12 and the fastening block A of the lower module 13, are opened in the middle shielding sheet 5. When the upper module 12 and the lower module 13 are fixed through fastening, the fastening block A passes through the mounting hole 511 to fit the fastening groove B, so that the middle shielding sheet 5 is fixed between the upper module 12 and the lower module 13. Therefore, the middle shielding sheet 5 is fixed in a simple manner and is easy to assemble, and another fixing structure does not need to be added for fixing, ensuring a simple structure.

As shown in FIGS. 1, 2, and 7, the shielding case 6 covers the frame body 11. That is, the retaining elastic sheet 4 is located inside the shielding case 6. A gap is provided between the shielding case 6 and the retaining elastic sheet 4. The gap includes clearance at upper and lower sides of the retaining elastic sheet 4 and at upper and lower sides of the shielding case 6, and clearance at left and right sides of the retaining elastic sheet 4 and at left and right sides of the shielding case 6. That is, the shielding case 6 and the retaining elastic sheet 4 are formed independently, and the retaining elastic sheet 4 does not contact the shielding case 6. At least one pressing portion 61 is extended from a rear end of the shielding case 6 to enter the receiving space 118 and contact the protruding portion 53. To facilitate contact with the protruding portion 53, in this embodiment, two pressing portions 61 are extended from the shielding case 6 to correspondingly contact two protruding portions 53. The two pressing portions 61 are respectively provided at two sides of the shielding case 6 in a convex manner, and are perpendicular to the plate surfaces of the first terminal group 2 and the second terminal group 3. A top surface of the shielding case 6 extends downwards to form two soldering legs 62, and the two soldering legs 62 are soldered on the circuit board in a surface mounting manner.

As shown in FIGS. 2, 3, and 5, the mating connector 100 further includes an upper shielding sheet 7 and a lower shielding sheet 8. The upper shielding sheet 7 is fixed on the top surface of the frame body 11, the lower shielding sheet 8 is fixed on the bottom surface of the frame body 11, and both the upper shielding sheet 7 and the lower shielding sheet 8 are located inside the shielding case 6 and contact the shielding case 6. The upper shielding sheet 7 is located above the first terminal group 2 and is used to shield an interference signal above the first terminal group 2. The lower shielding sheet 8 is located below the second terminal group 3 and is used to shield an interference signal below the second terminal group 3. The middle shielding sheet 5 is located below the first terminal group 2 and above the second terminal group 3, so that the middle shielding sheet 5 is used to shield interference signals below the first terminal group 2 and above the second terminal group 3. In other words, the mating connector 100 is provided with the upper shielding sheet 7, the lower shielding sheet 8, and the middle shielding sheet 5 to shield interference signals above and below the first terminal group 2 and interference signals above and below the second terminal group 3, and provide multi-layer shielding protection for the first terminal group 2 and the second terminal group 3, thereby enhancing a shielding effect of the mating connector 100. Both the upper shielding sheet 7 and the lower shielding sheet 8 are provided with at least one grounding portion C in a convex manner to contact the shielding case 6, and both the upper shielding sheet 7 and the lower shielding sheet 8 bend to form at least one mating portion D to contact the electrical connector 200. In this embodiment, there are multiple grounding portions C and mating portions D. The multiple grounding portions C and mating portions D are located at the same side of the upper shielding sheet 7 and the same side of the lower shielding sheet 8. The multiple grounding portions C and the multiple mating portions D on the upper shielding sheet 7 and the lower shielding sheet 8 are disposed alternately. The multiple grounding portions C abut an inner wall surface of the shielding case 6 to ensure a desirable grounding effect of the upper shielding sheet 7 and the lower shielding sheet 8, and the multiple mating portions D are located in the mating space 114 and are mated to the electrical connector 200 to ensure electrical connection performance of the mating portions D. The upper shielding sheet 7 and the lower shielding sheet 8 are respectively provided with a through-hole E corresponding to the multiple first connection guiding portions 212 and the multiple second connection guiding portions 312, so as to retreat from the first connection guiding portion 212 of the first terminal 21 and the second connection guiding portion 312 of the second terminal 31 and avoid a short circuit caused by contact between the first connection guiding portion 212 and the upper shielding sheet 7 or contact between the second connection guiding portion 312 and the lower shielding sheet 8. The frame body 11 is provided with a blocking block 119 in a convex manner in the through-hole area E, and the blocking block 119 stops the upper shielding sheet 7 and the lower shielding sheet 8 to prevent the upper shielding sheet 7 and the lower shielding sheet 8 from separation or displacement from the frame body 11. The frame body 11 is provided with the support portions 112 below the grounding portion C in a convex manner, so as to support the grounding portion C to contact the shielding case 6, prevent the grounding portion C from moving downwards and being unable to abut the shielding case 6, and prevent the upper shielding sheet 7 and the lower shielding sheet 8 from losing a grounding function.

Figure 4:
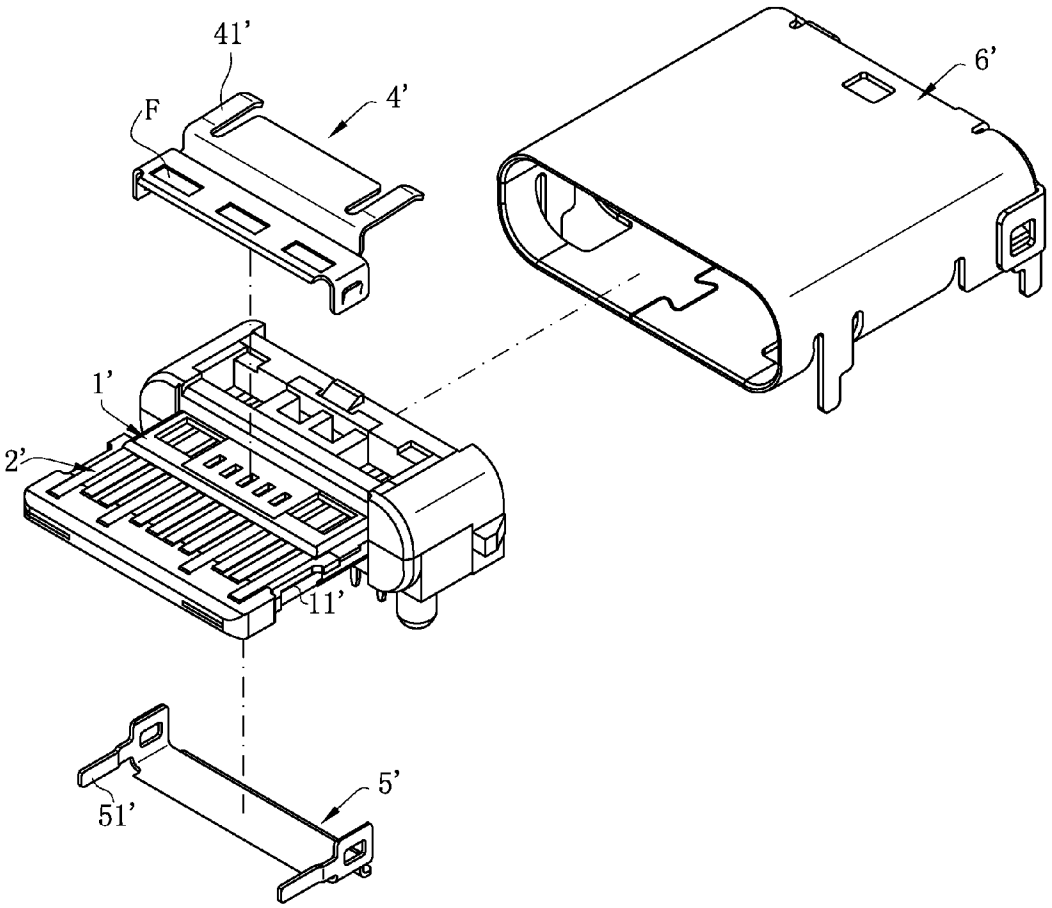
FIG. 4 is a schematic three-dimensional exploded view of an electrical connector according to one embodiment of the present invention.

As shown in FIGS. 4, 5, and 7, the mating connector 100 is used to mate with the electrical connector 200. The electrical connector 200 includes an insulation body 1', and multiple third terminals 2' and multiple fourth terminals 3' that are received in the insulation body 1'. Two side surfaces of the insulation body 1' are respectively provided with a concave trench 11' in a concave manner, and the retaining elastic sheet 4 presses the concave trench 11' to increase plugging and unplugging forces between the mating connector 100 and the electrical connector 200. Because the retaining elastic sheet 4 is perpendicular to the middle shielding sheet 5, that is, the retaining elastic sheet 4 is parallel to a side surface of the insulation body 1', the retaining elastic sheet 4 abuts the concave trench 11' in a surface contact manner, so that the retaining elastic sheet 4 achieves secure contact and stable plugging and unplugging, so as to further fix the electrical connector 200 and avoid loosening. The electrical connector 200 further includes an upper grounding sheet 4' located on a top surface of the insulation body 1', a lower grounding sheet 5' located on a bottom surface of the insulation body 1', and a metal case 6' covering the insulation body 1'. Both the upper grounding sheet 4' and the lower grounding sheet 5' are located inside the metal case 6'. The upper grounding sheet 4' has an elastic arm 41' to contact the metal case 6' for grounding, and the lower grounding sheet 5' contacts the upper grounding sheet 4' for grounding. A contact arm 51' is extended separately from two sides of the lower grounding sheet 5', and each contact arm 51' is correspondingly located in the concave trench 11' and contacts the retaining elastic sheet 4. Both the upper grounding sheet 4' and the lower grounding sheet 5' are provided with at least one concave portion F. In this embodiment, there are multiple concave portions F, and in other embodiments, there is only one concave portion F. In this embodiment, the upper shielding sheet 7 and the lower shielding sheet 8 respectively abut the upper grounding sheet 4' and the lower grounding sheet 5' to achieve a shielding effect in a mating area. In other embodiments, both the upper shielding sheet 7 and the lower shielding sheet 8 abut the metal case 6' as long as a shielding effect is achieved in mating area.

Figure 6:
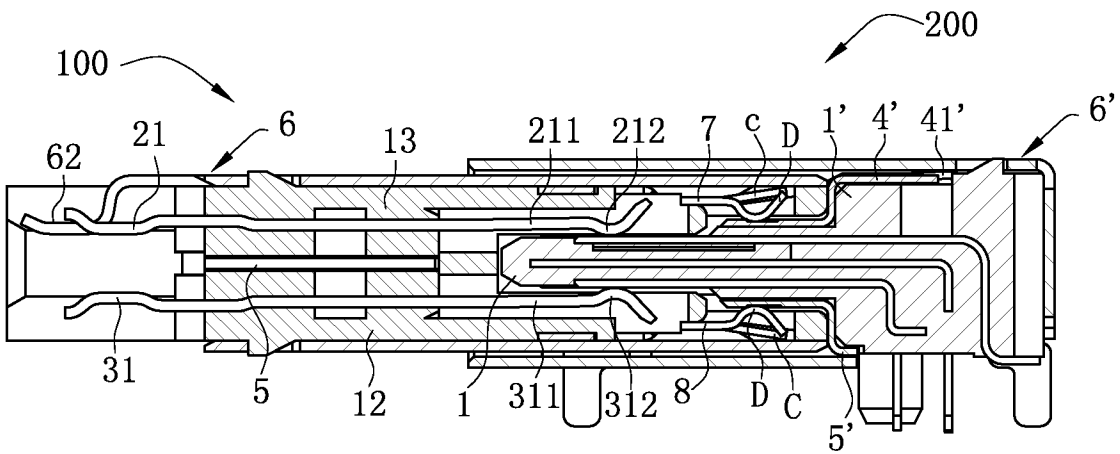
FIG. 6 is a schematic plane sectional view of a mating connector and an electrical connector after mating according to one embodiment of the present invention.

As shown in FIG. 2 and FIG. 6, the concave portion F of the upper grounding sheet 4' contacts the mating portion D of the upper shielding sheet 7, and the concave portion F of the lower grounding sheet 5' contacts the mating portion D of the lower shielding sheet 8. The provision of the concave portion F increases plugging and unplugging forces of the mating connector 100 during mating, so that the mating connector 100 is securely plugged to the electrical connector 200 and loosening does not easily occur.

As shown in FIGS. 2, 5, and 7, during assembly, the upper module 12 and the first terminal group 2 are first integrally formed through insertion molding, the lower module 13 and the second terminal group 3 are integrally formed through insertion molding, then the upper module 12 and the lower module 13 are assembled in a vertical direction. The middle shielding sheet 5 is located between the upper module 12 and the lower module 13. The fastening block A passes through the mounting hole 511 to be fastened to the fastening groove B. The middle shielding sheet 5 is fixed between the upper module 12 and the lower module 13 while the upper module 12 and the lower module 13 are securely fixed. The assembled upper module 12 and lower module 13 are mounted in the positioning space 113 of the frame body 11 to form the plastic body 1. The multiple first terminal groups 2 protrude from the upper module 12 to enter the upper-row terminal slots 111. The first connection guiding portion 212 is located in the mating space 114. The multiple second terminal groups 3 protrude from the lower module 13 to enter the lower-row terminal slots. The second connection guiding portion 312 is located in the mating space 114. The circuit board is located in the receiving space 118, and the first terminal group 2 and the second terminal group 3 are soldered on the circuit board. The two retaining elastic sheets 4 are respectively located at two opposite sides of the first terminal group 2 and the second terminal group 3. The fixing portion 42 is located in the retaining groove 116 of the frame body 11, the plate portion 43 abuts the urging portion 52 of the middle shielding sheet 5, the elastic portion 44 is located in the hollowed portion 115, and the protruding portion 53 of the middle shielding sheet 5 is located in the receiving space 118 and abuts the pressing portion 61 of the shielding case 6. The upper shielding sheet 7 is mounted on the top surface of the frame body 11, the lower shielding sheet 8 is mounted on the bottom surface of the frame body 11, the grounding portion C contacts the shielding case 6, and the mating portion D protrudes into the mating space 114.

As shown in FIGS. 6-8, during mating, the first connection guiding portion 212 mates with the third terminals 2', the second connection guiding portion 312 mates with the fourth terminals 3', the mating portion D of the upper shielding sheet 7 contacts the concave portion F of the upper grounding sheet 4', the mating portion D of the lower shielding sheet 8 contacts the concave portion F of the lower grounding sheet 5', the elastic portion 44 of the retaining elastic sheet 4 protrudes into the concave trench 11' and contacts the contact arm 51' of the lower grounding sheet 5'. Because the middle shielding sheet 5 contacts the two retaining elastic sheets 4, the two retaining elastic sheets 4 contact the contact arm 51' at two sides of the lower grounding sheet 5', the lower grounding sheet 5' contacts the upper grounding sheet 4', the upper grounding sheet 4' contacts the metal case 6', that is, the middle shielding sheet 5, the retaining elastic sheet 4, the lower grounding sheet 5', and the upper grounding sheet 4' together form a ground loop, and consequently interference signals between the mated first terminal 21, second terminal 31, third terminals 2', and fourth terminals 3' are shielded, so that the mating connector 100 is successfully mated with the electrical connector 200, and it is ensured that signal transmission is not affected.

In conclusion, the mating connector 100 of the present invention, among other things, has the following beneficial advantages.

(1) The two retaining elastic sheets 4 are respectively located at the opposite two sides of the first terminal group 2 and the second terminal group 3, and contact the middle shielding sheet 5, thereby eliminating the interference signal between the two side surfaces of the first terminal group 2 and the second terminal group 3. The middle shielding sheet 5 is located between the first terminal group 2 and the second terminal group 3, thereby eliminating an interference signal between the plate surface of the first terminal group 2 and the plate surface of the second terminal group 3. Therefore, the provision of the retaining elastic sheet 4 and the middle shielding sheet 5 enhances an anti-interference capability of the mating connector 100, ensures a desirable shielding effect of the mating connector 100, and improves signal transmission quality. In addition, the retaining elastic sheet 4 is retained at the plastic body 1, so as to provide stable plugging and unplugging forces for the mating connector 100, and ensure secure mating to and stable connection between the mating connector 100 and the electrical connector 200, and the loosening problem does not occur easily, thereby ensuring electrical connection performance of the mating connector 100.

(2) Two mounting holes 511, corresponding to the fastening block A of the upper module 12 and the fastening block A of the lower module 13, are opened in the middle shielding sheet 5. When the upper module 12 and the lower module 13 are fixed through fastening, the fastening block A passes through the mounting hole 511 to fit the fastening groove B, so that the middle shielding sheet 5 is fixed between the upper module 12 and the lower module 13. Therefore, the middle shielding sheet 5 is fixed in a simple manner and is assembled easily, and another fixing structure does not need to be added for fixing, ensuring a simple structure.

(3) The middle shielding sheet 5 contacts the two retaining elastic sheets 4, the two retaining elastic sheets 4 contact the contact arm 51' at two sides of the lower grounding sheet 5', the lower grounding sheet 5' contacts the upper grounding sheet 4', the upper grounding sheet 4' contacts the metal case 6', that is, the middle shielding sheet 5, the retaining elastic sheet 4, the lower grounding sheet 5', and the upper grounding sheet 4' together form a ground loop, and consequently interference signals between the mated first terminal 21, second terminal 31, third terminals 2', and fourth terminals 3' are shielded, so that the mating connector 100 is successfully mated with the electrical connector 200, and it is ensured that signal transmission is not affected.

(4) The concave portion F of the upper grounding sheet 4' contacts the mating portion D of the upper shielding sheet 7, and the concave portion F of the lower grounding sheet 5' contacts the mating portion D of the lower shielding sheet 8. The provision of the concave portion F increases plugging and unplugging forces of the mating connector 100 during mating, so that the mating connector 100 is securely mated with the electrical connector 200 and loosening does not easily occur.

(5) The elastic portion 44 is located in the hollowed portion 115 in a movable manner and presses the electrical connector 200, and the hollowed portion 115 provides a retreating space for the elastic portion 44. When the electrical connector 200 abuts the elastic portion 44, the elastic portion 44 is pressed to move out from the hollowed portion 115, so that the electrical connector 200 is conveniently inserted in the mating connector 100. When the electrical connector 200 is separated from the elastic portion 44, the elastic portion 44 is restored to an original position through the elasticity of the elastic portion 44, so that the electrical connector 200 is conveniently removed from the mating connector 100.

The foregoing detailed description shows merely preferred embodiments of the present invention, and is not intended to limit the patent scope of the present invention; therefore, all equivalent technical changes made according to this specification of the present invention and content of the drawings shall fall within the patent scope of the present invention.

While there has been shown several and alternate embodiments of the present invention, it is to be understood that certain changes can be made as would be known to one skilled in the art without departing from the underlying scope of the present invention as is discussed and set forth above and below including claims. Furthermore, the embodiments described above and claims set forth below are only intended to illustrate the principles of the present invention and are not intended to limit the scope of the present invention to the disclosed elements.

What is claimed is:

1. A mating connector, comprising:

a plastic body;

a first terminal group and a second terminal group disposed in an upper row and a lower row respectively in the plastic body;

at least one retaining elastic sheet retained at the plastic body, and located at a side of the first terminal group and the second terminal group;

a middle shielding sheet retained at the plastic body and located between the first terminal group and the second terminal group, wherein at least one urging portion is extended from the middle shielding sheet, and abuts the retaining elastic sheet; and a shielding case covering the plastic body and contacting the middle shielding sheet, wherein the shielding case and the retaining elastic sheet are formed independently.

2. The mating connector according to claim 1, wherein one side of the plastic body is concavely provided with a receiving space, the middle shielding sheet is convexly provided with at least one protruding portion located in the receiving space, and at least one pressing portion is extended from the shielding case to enter the receiving space and contact the protruding portion.

3. The mating connector according to claim 2, wherein the middle shielding sheet has a body portion located in the plastic body, one end of the body portion extends to form the protruding portion, the other end of the body portion bends and extends towards the protruding portion to form the urging portion, and an extending direction of the urging portion is perpendicular to an extending direction of the protruding portion.

4. The mating connector according to claim 3, wherein a bolstering portion is extended from the end of the body portion having the urging portion, an extending direction of the bolstering portion is opposite to that of the urging portion, and the bolstering portion contacts the retaining elastic sheet.

5. The mating connector according to claim 2, wherein a trench is opened in the retaining elastic sheet, two sides of the trench are respectively provided with a fixing portion, the fixing portions are fixed with the plastic body, and the protruding portion passes through the trench, protrudes from the trench, and is located in the receiving space.

6. The mating connector according to claim 5, wherein the protruding portion contacts a side wall surface of the trench.

7. The mating connector according to claim 5, wherein a plate portion is extended from the fixing portion of the retaining elastic sheet, the plate portion abuts the urging portion, an elastic portion is extended forwards from the plate portion, and the elastic portion is located at a front end of the plastic body and is used to press an electrical connector.

8. The mating connector according to claim 1, wherein the retaining elastic sheet is perpendicular to the middle shielding sheet.

9. The mating connector according to claim 1, wherein a side wall of the plastic body is concavely provided with a hollowed portion, one end of the retaining elastic sheet is retained at the plastic body, the other end of the retaining elastic sheet is a free end that is located in the hollowed portion.

10. The mating connector according to claim 1, wherein the plastic body comprises a frame body, an upper module, and a lower module, the upper module and the first terminal group are integrally formed through insertion molding, the lower module and the second terminal group are integrally formed through insertion molding, the middle shielding sheet is sandwiched between the upper module and the lower module, the upper module and the lower module are fixed in the frame body, a front end of the frame body is provided with multiple terminal slots, and both the first terminal group having multiple first connection guiding portions and the second terminal group having multiple second connection guiding portions are located in the terminal slots.

11. The mating connector according to claim 10, wherein the upper module has a fastening block in a convex manner, the lower module has a fastening groove in a concave manner, the middle shielding sheet has a mounting hole corresponding to the fastening block, and the fastening block penetrates the mounting hole to be fastened to the fastening groove.

12. The mating connector according to claim 10, further comprising an upper shielding sheet and a lower shielding sheet separately retained at the frame body, wherein the upper shielding sheet is located above the first terminal group, the lower shielding sheet is located below the second terminal group, and each of the upper shielding sheet and the lower shielding sheet has at least one grounding portion to contact the shielding case and at least one mating portion to contact an electrical connector.

13. The mating connector according to claim 12, wherein the upper shielding sheet and the lower shielding sheet each comprise a through-hole area, and the multiple first connection guiding portions and the multiple second connection guiding portions are located in the through-hole area.

14. The mating connector according to claim 12, used to mate with the electrical connector, wherein the electrical connector comprises a metal case, and both the upper shielding sheet and the lower shielding sheet abut the metal case.

15. The mating connector according to claim 12, used to mate with the electrical connector, wherein the electrical connector comprises an upper grounding sheet, a lower grounding sheet, and a metal case, the upper grounding sheet contacts the metal case, the lower grounding sheet contacts the upper grounding sheet, at least one contact arm is extended from the lower grounding sheet, and the contact arm contacts the retaining elastic sheet.

16. The mating connector according to claim 15, wherein the upper grounding sheet has at least one concave portion contacting the mating portion of the upper shielding sheet, and the lower grounding sheet has at least one concave portion contacting the mating portion of the lower shielding sheet.

* * * * *